United States Patent [19]

Deland

[11] Patent Number: 4,488,657

[45] Date of Patent: Dec. 18, 1984

[54] WATER COOLER BOTTLE CLOSURE

[76] Inventor: Francois Deland, 250 Montigny, Mont St-Hilaire, Québec, Canada, J3H 2L9

[21] Appl. No.: 480,107

[22] Filed: Mar. 29, 1983

Related U.S. Application Data

[63] Continuation-in-part of Ser. No. 428,396, Sep. 29, 1982.

[51] Int. Cl.[3] ..... B65D 47/14

[52] U.S. Cl. ..... 215/303; 215/306; 215/307

[58] Field of Search ..... 215/354, 303, 306, 307, 215/273, 274, 277

[56] References Cited

U.S. PATENT DOCUMENTS 1,102,497 7/1914 Green ..... 215/303

2,206,118 7/1940 Pahls et al. ..... 215/354 X

*Primary Examiner*—Donald F. Norton

*Attorney, Agent, or Firm*—Oblon, Fisher, Spivak, McClelland & Maier

[57] ABSTRACT

A water cooler bottle closure made of a closure cap adapted to fit over the neck of a water cooler bottle, which closure cap has an opening formed at its bottom. A flange projects around the periphery of the opening to define an inner chamber. A base is provided to close the inner chamber so as to enable the formation of an ice plug in the inner chamber when the latter has been filled with water and subjected to freezing conditions. A water bottle fitted with such a closure, after having removed its base, can be tilted over a water cooler and during that process no spill takes place. The plug of ice then slowly melts and water runs into the cooler in the usual manner. The base can be mounted at the bottom or at the top of the inner chamber during the formation of the ice plug. The base can also be used without the formation of an ice plug and in such a case it is merely necessary to unsnap the base such as by pulling on a piece of string attached to the base.

5 Claims, 9 Drawing Figures

WATER COOLER BOTTLE CLOSURE

This is a continuation-in-part of Ser. No. 428,396, filed Sept. 29, 1982.

BACKGROUND OF INVENTION (a) Field of the Invention

This invention relates to a water cooler bottle closure. More particularly, the present invention is directed to a device of the kind which enables to mount a water bottle over a water cooler while preventing any escape of water from the bottle during the tilting operation. After the bottle has been placed over the water cooler, water starts to flow into the cooler to be available to anyone.

(b) Description of Prior Art

Modern civilization has brought the pollution of an important portion of the water supply, to the extent that drinkable water which is harmless and pleasant to the taste is getting rare. In many places, such as in industrial plants and offices, as well as in homes, it is common to see fresh spring water made available through the use of a water bottle mounted upside down over a water cooler, with the neck plunging into the top part of the cooler. The difficulty with such an arrangement is that the bottle which is often very heavy must first of all be uncorked, and then tilted 180° to be mounted over the cooler with the neck down. It is obvious that this is an operation which is tedious and which has to be executed with some speed, in order to prevent any spill of water. A system which would be ideal would block the water flow from the moment the water bottle is tilted until it is well settled over the water cooler.

To my knowledge there is not available any system which would be effective in arriving at a reasonable solution to the problem mentioned above. I am aware of U.S. Pat. No. 1,635,438 which relates to an ice cap. Although it could be used to refrigerate a bottle of milk during delivery, it could not safely be mounted on a water bottle to prevent water spill because it could not stay on the neck when tilting a water bottle.

SUMMARY OF INVENTION

In order to overcome the above disadvantages, I have provided a water cooler bottle closure comprising a closure cap adapted to fit over the neck of a water cooler bottle, the closure cap having an opening formed at the bottom thereof, flange means projecting aroung the periphery of the opening, the flange means defining an inner chamber which is associated with the closure cap, and a base to close the inner chamber so as to enable the formation of an ice plug in the inner chamber when the inner chamber has been filled with water and the water has been subjected to freezing conditions.

Even more broadly, I have provided a water cooler bottle closure comprising a closure cap adapted to fit over the neck of a water cooler bottle, the closure cap having an opening formed at the bottom thereof, flange means projecting around the periphery of the opening, the flange means defining an inner chamber which is associated with the closure cap, and a removable base to close the inner chamber.

In accordance with a preferred embodiment of the invention the opening is circular and the inner chamber is cylindrical.

In accordance with yet another embodiment of the invention the flange means comprises a circular wall which projects around the circular opening from the bottom of the closure cap, so that the cylindrical inner chamber lies entirely inside the closure cap.

In accordance with yet another embodiment of the invention the circular wall is interiorly corrugated, or preferably has an inner circular rib so as to prevent the plug of ice from slipping outside the inner chamber.

In accordance with yet another embodiment of the invention, the base comprises first means to enable it to fit snugly into the opening.

In accordance with yet another embodiment of the invention, the base comprises second means to enable it to fit snugly at the top of the inner chamber.

In accordance with still another embodiment of the invention the base is made of resilient material, an annular inner collar is provided in the inner chamber at the opening, the base comprises a disc portion having outwardly tapered walls enabling the disc portion to snap over the annular collar and to fit snugly and imperviously into the opening, and a gripping portion integral with the disc portion and enabling to permit easy insertion and removal of the disc portion into and from the opening.

In accordance with yet another embodiment of the invention, a piece of string is attached to the base and is long enough to extend past the contact between the bottle and the water cooler when the bottle is mounted over the water cooler. It will be realized that by pulling on the string the base is removed from the opening and water starts descending into the water cooler.

BRIEF DESCRIPTION OF DRAWINGS

The invention is illustrated by means of the following drawings in which.

DESCRIPTION OF PREFERRED EMBODIMENTS

Figure 1:
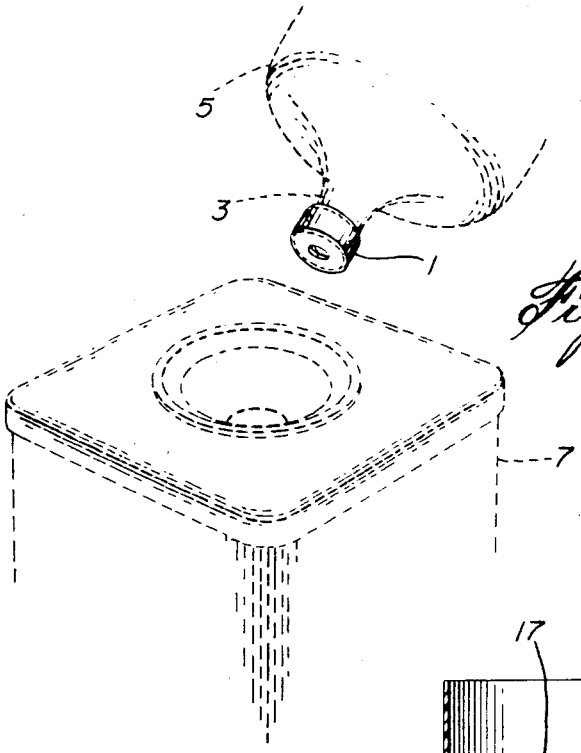
FIG. 1 is a perspective view of a water cooler and water bottle, fitted with a closure cap according to the invention, being placed over the water cooler.
Figure 2:
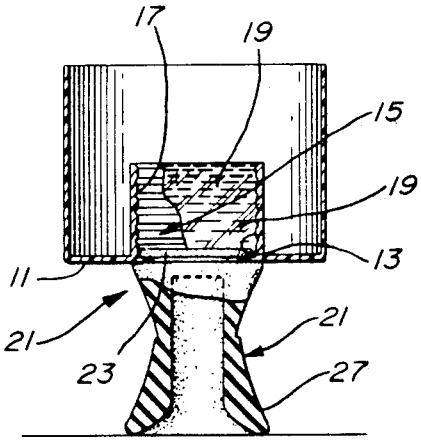
FIG. 2 is a cross-section view of a closure cap according to the invention.
Figure 3:
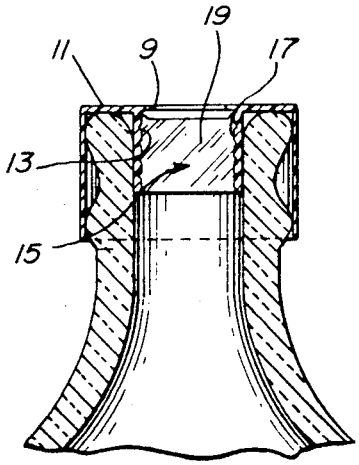
FIG. 3 is a cross-section view of the same closure cap mounted over a water bottle.
Figure 4:
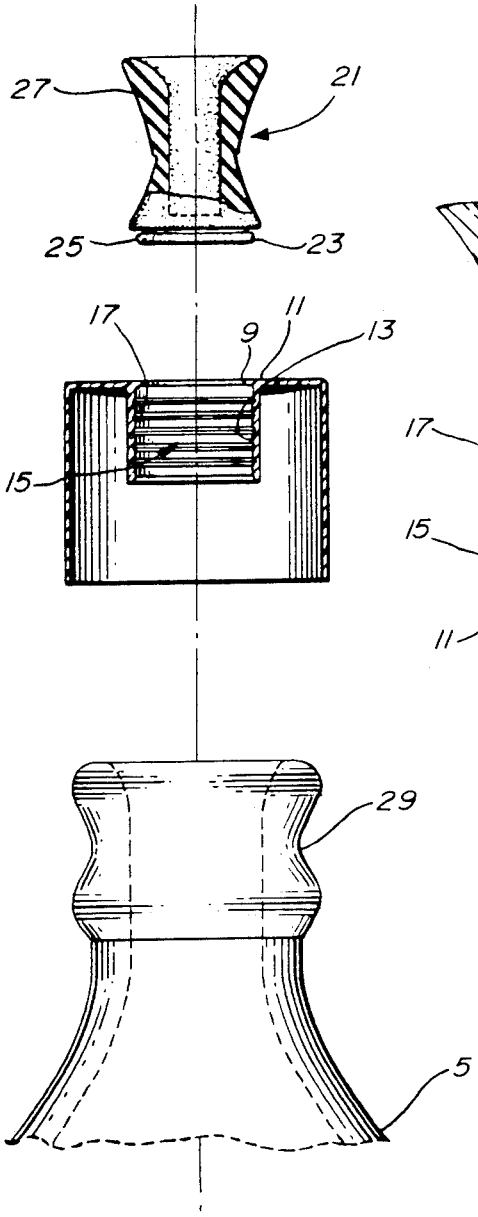
FIG. 4 is an exploded view showing the various parts of the closure cap illustrated in FIGS. 2 and 3, as well as a water bottle neck.
Figure 5:
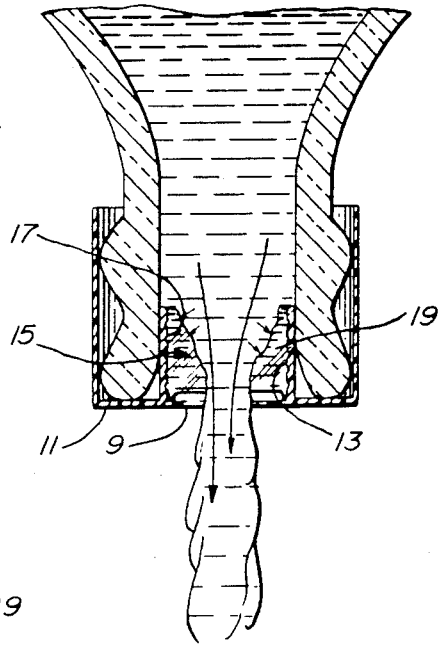
FIG. 5 is a view showing the melting of an ice plug formed in a device according to the invention.
Figure 7:
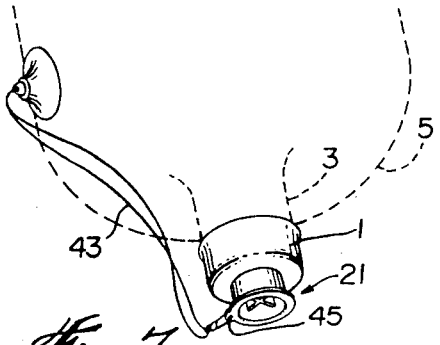
FIG. 7 is a view of the closure cap illustrated in FIG. 6, mounted on the neck of a bottle and provided with a base remover.

Referring to the drawings, there is shown a closure cap 1 which is fitted over the neck 3 of a water bottle 5, the whole to be placed on a water cooler 7, as shown in FIG. 1 of the drawing. As illustrated in FIGS. 3, 4 and 5, the closure cap 1 has a circular opening 9 formed at its bottom 11. A circular wall 13 projects around the circular opening 9, in the manner shown in FIGS. 2 to 5, from the bottom 11 of the closure cap 1, to define an inner cylindrical chamber 15 which is integral with the closure cap 1. Also as shown, the inner cylindrical chamber 15 lies entirely inside the closure cap 1. Of course, this is not essential and, as well known to those skilled in the art, the inner cylindrical chamber could be partly or entirely outside the closure cap 1.

The closure cap 1 described above can be made of any well known material. However, it is recommended to use a plastic material which can easily be molded. It has been found through experience that the closure cap 1 can more easily be fabricated by molding, and the particular technique involved is outside the scope of the present invention and is entirely left to those skilled in the art.

The inner cylindrical chamber 15 has corrugations 17 along the interior wall 13 thereof. The reason for providing these corrugations 17 along the interior wall 13 is to prevent the ice plug 19, which will be described below, from slipping outside the inner chamber 15 when handling the closure cap.

As another part of the device according to the invention, there is a base 21 which is preferably made of resilient material such as rubber. The base 21 comprises a disc portion 23 which has outwardly tapered walls 25. The tapered walls 25 will enable the disc portion 23 of the base 21 to fit snugly and imperviously into the opening 9 of the closure cap 1, all as shown in FIG. 2 of the drawings. The base 21 also has a handle 27 which is integral with the disc portion 23 and enables to insert the disc portion 23 into the opening 9. The handle 27 also permits to free the opening 9 before mounting the closure cap on the neck 3 of the bottle 5. The handle portion 27 can have any shape desired. In the model illustrated, it appears as a truncated cone. However, one can elect the type of handle of his choice.

It will therefore be seen that when the water cooler bottle closure is not in use, the handle 27 should be mounted on the closure 1 by fitting the disc portion 23 in the circular opening 9 of the closure 1. Because of the tapered walls 25 of the disc portion 23, the handle 27 and the base 21 will be firmly held by the bottle closure 1. Then the chamber 15 is filled with water and the bottle closure 1 is placed in a freezer in the position shown in FIG. 2 of the drawings, where an ice plug 19 will be formed in the cylindrical chamber 15.

When a bottle of natural water 5 is intended to be mounted on a water cooler 7, the cap 29 of the water bottle 5 is removed and the bottle closure 1 with its base 21 is mounted over the neck 3 of the water bottle 5 in the manner shown in FIG. 5 of the drawings. The base 21 is thereafter removed and the bottle with its closure is tilted over and mounted on a water cooler.

As the ice melts, water starts to descend into the cooler until the bottle is empty.

After removing the water bottle from over the cooler, the bottle closure is removed from the neck of the water bottle, the base 21 is mounted in the circular opening, the inner chamber is filled with water and the assembly is placed in a freezer for further use.

The device illustrated in FIGS. 1 to 5 could be made more compact and could even be modified to be used without requiring the formation of an ice plug.

Reference is made to FIGS. 6 to 9 for an alternate embodiment, where the like parts will be identified by the same reference numerals.

As in the previous embodiment, the closure cap 1 is also intended to be fitted over the neck 3 of a water bottle 5, the whole to be placed on a water cooler 7. The closure cap 1 of the alternate embodiment also has a circular opening 9, a bottom 11, a circular wall 13 and an inner cylindrical chamber 15.

Instead of being provided with corrugations 17, the inner chamber 15 of the alternate embodiment has an inner circular rib 31 which is more simple and serves the same purposes.

The base 21, which is formed of a cylindrical member 33 and a gripping portion 35 has at the end of the cylindrical member 33 a stepped portion 23 which has slightly tapered walls 25. The stepped portion 23 fit snuggly and imperviously into the end of the inner chamber 15 as shown in FIG. 6 so that an ice plug can be formed in the chamber 15.

The cylindrical member 33 also has an annularly stepped portion 39 to define a shoulder 41. The stepped portion 39 will permit tight mounting of the cylindrical member 33 on the cylindrical inner chamber 15 at the opening 9. With respect to the gripping portion 35 which is substantially part of the handle 27, it is integral with the cylindrical member 33 so as to permit easy insertion and removal of the cylindrical member 33 into and from the opening 9, or alternately, onto and off of the end of the inner chamber 15 opposite the opening 9.

A piece of string 43 is attached to the base 21 at 45 of the gripping portion 35 and, as shown, is long enough to extend past the contact between the bottle 5, and the water cooler 7 when the bottle is mounted over the water cooler. By pulling on the string, the base is unsnapped and water starts to descend in the water cooler. Of course, any other means known per se could be used to unsnap the base 21 without departing from the scope of the present invention.

Figure 6:
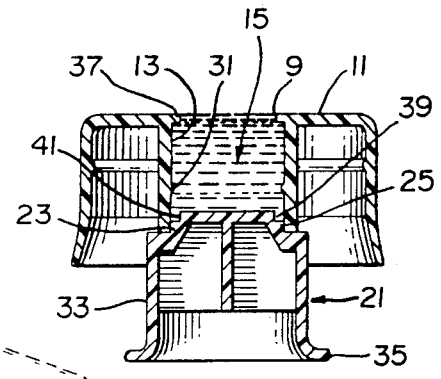
FIG. 6 is a cross-section view of a modified closure cap.

When a freezer is available, the base 21 is mounted over the cylindrical inner chamber 15 at the end opposite the opening 9 by means of the stepped portion 23 as shown in FIG. 6.

Figure 8:
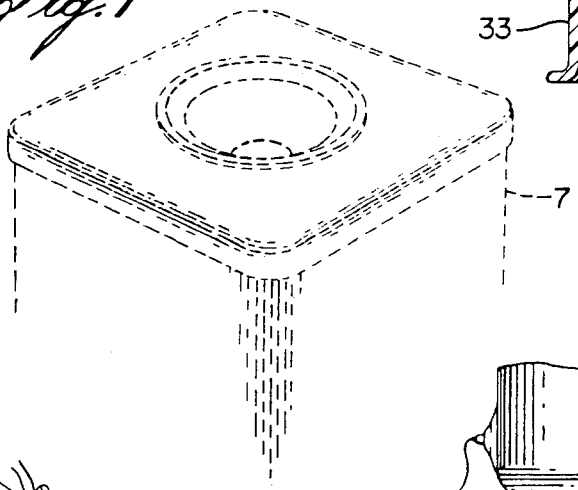
FIG. 8 is a view of the closure cap shown in FIG. 7 with the bottle placed on the water cooler.
Figure 8:
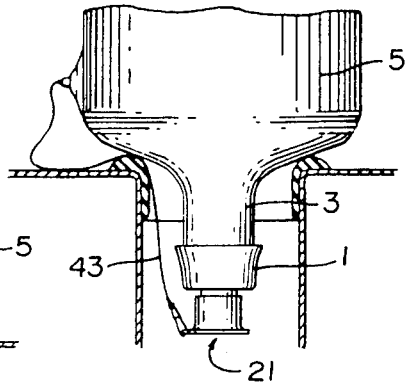
Figure 9:
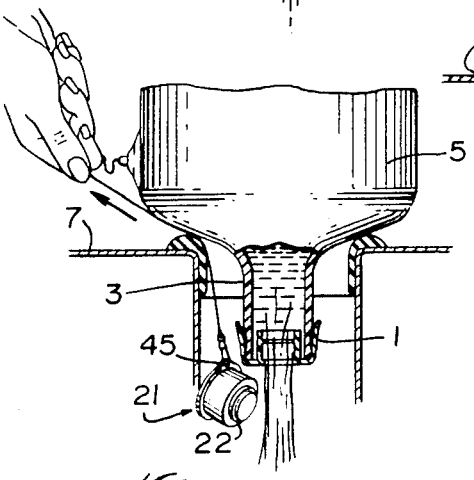
FIG. 9 is a view showing the removal of the closure cap after having placed the bottle on a water cooler.

The cylindrical chamber is filled with water and said water cooler bottle closure is placed in a freezer to form an ice plug in the cylindrical inner chamber. Then, when one intends to mount a bottle of water on the water cooler, the water cooler bottle closure is fitted over the neck of the bottle after having removed the base therefrom and the bottle provided with the closure is thereafter tilted and mounted on the water cooler, where the ice plug melts and water starts to descend in the water cooler. When a freezer is not available the base is mounted into said opening 9 with the stepped portion 39 (FIG. 8). The water cooler bottle closure is fitted over the neck of the bottle; the bottle provided with the closure is thereafter tilted and mounted on the water cooler, then the free end of the piece of string is pulled to unsnap the base from the opening and water starts to descend into said water cooler.

I claim:

1. A water cooler bottle closure comprising:

a closure cap adapted to fit over the neck of a water cooler bottle, said closure cap having an opening formed at the bottom thereof, a continuous wall projecting around the peripery of said opening to define an inner chamber which is associated with said closure cap and is adapted to fit inside the neck portion of the water cooler bottle, said inner chamber having a bottom end at the level of the bottom of said closure cap and a top at the other end of said inner chamber, said continuous wall being set back with respect to said opening to define a flange, a base including first means formed in said base and engageable by said flange to imperviously close the bottom end of said chamber, and second means different from said first means and formed in said base to enable said base to fit snugly at the top of said inner chamber, so that when said base is mounted at the top of said inner chamber, said base enables the formation of an ice plug in said inner chamber when said inner chamber has been filled with water and said water has been subjected to freezing conditions.

2. A water cooler bottle closure according to claim 1, wherein said continuous wall is circular and said inner is cylindrical.

3. A water cooler bottle closure according to claim 1, wherein said base is made of resilient material, said base comprises a first stepped portion which is outwardly tapered to enable said first stepped portion to snap over said flange and to fit snugly and imperviously into said opening, said base also comprising a gripping portion integral with said first stepped portion to permit easy insertion and removal of said first stepped portion into and from said opening.

4. A water cooler bottle closure according to claim 1, which comprises a piece of string attached to said base and long enough to extend past contact between said bottle and said water cooler when said bottle is mounted over said water cooler with said first means engaging said flange, whereby by pulling on said string said base is removed from said opening and water starts descending into said water cooler.

5. A water cooler bottle closure comprising a closure cap adapted to fit over the neck of a water cooler bottle, said closure cap having a circular opening formed at the bottom thereof, a circular wall which projects around said circular opening from the bottom of said closure cap to define an inner cylindrical chamber which is integral with said closure cap and lies entirely inside said closure cap, said circular wall being set back with respect to said opening to define a flange, a base made of a resilient material, said base comprising a cylindrical member which is terminated by a first stepped portion which is outwardly tapered to enable said first stepped portion to fit snugly and imperviously into said opening, said cylindrical member having a second stepped portion to define a shoulder past said first stepped portion, said second stepped portion permitting tight mounting of said cylindrical member over said cylindrical inner chamber at the end opposite said opening, a gripping portion integral with said cylindrical member to permit easy insertion and removal of said cylindrical member into and from said opening or alternately over and from the end of said inner chamber opposite said opening, a piece of string attached to said base at the gripping portion thereof and long enough to extend past the contact between said bottle and said water cooler when said bottle is mounted over said water cooler with the first stepped portion fitted into said opening, so constructed and arranged so that when a freezer is available, said base is mounted over said cylindrical inner chamber at the end opposite said opening by means of said second stepped portion.

* * * * *